US005928487A

United States Patent [19]

Sinsel et al.

[11] Patent Number: 5,928,487

[45] Date of Patent: Jul. 27, 1999

[54] ELECTROLYTIC PLATING OF STEEL SUBSTRATE

[75] Inventors: John A. Sinsel; Lowell W. Austin, both of Weirton, W. Va.

[73] Assignee: Weirton Steel Corporation, Weirton, W. Va.

[21] Appl. No.: 09/076,979

[22] Filed: May 13, 1998

Related U.S. Application Data

[62] Division of application No. 08/577,972, Dec. 22, 1995, abandoned.

[51] Int. Cl.[6] ..... C25D 3/30

[52] U.S. Cl. ..... 205/300

[58] Field of Search ..... 205/300

[56] References Cited

U.S. PATENT DOCUMENTS

| | | | |
|---|---|---|---|
| 3,954,571 | 5/1976 | Eppensteiner et al. | 205/300 X |
| 5,378,347 | 1/1995 | Thomson et al. | 205/300 X |
| 5,451,323 | 9/1995 | Akao et al. | 205/300 X |

*Primary Examiner*—Donald R. Valentine
*Attorney, Agent, or Firm*—Shanley and Baker

[57] ABSTRACT

A new combination of steel strip electrolytic plating process steps which eliminate iron ion dissolution from continuous-strip steel substrate into chemically-corrosive plating solutions, such as Halogen-bath or methylsulphonic acid plating solutions, of horizontal passline electrolytic tin plating means which plate a single strip surface at a time. The previous use of a cyanide in Halogen-bath tin plating operations which formed a hazardous precipitant (prussian blue) is eliminated by eliminating iron ion dissolution from the steel strip substrate. And conversion of stannous ions to stannic ions, which formed additional Halogen-bath precipitant, is substantially eliminated. Also, new electrolytic plated product, with improved corrosion-prevention characteristics, is provided in which a flat-rolled steel substrate strike-coat of tin and/or nickel is plated simultaneously with electrolytic pickling of such cleansed substrate; pickle-plating is carried out prior to finish-surface electrolytic tin plating in such a horizontal passline electrolytic tin plating means.

1 Claim, 13 Drawing Sheets

ELECTROLYTIC PLATING OF STEEL SUBSTRATE

RELATED APPLICATION

This application is a division of co-owned U.S. patent application Ser. No. 08/577,972, entitled ELECTROLYTIC PLATING OF STEEL SUBSTRATE, filed Dec. 22, 1995, now abandoned.

INTRODUCTION

This invention relates to novel electrolytic plating processes, apparatus and improved product. More particularly, this invention is concerned with new methods and apparatus for preventing chemical corrosion of flat-rolled steel substrate during horizontal passline electrolytic tin plating operations in which one surface of the strip is plated at a time. In a specific embodiment of the invention, hazardous waste and other precipitation, which are detrimental to Halogen-bath tin plating operations, are eliminated.

BACKGROUND

Plating and handling advantages of horizontal passline electrolytic tin plating have helped to sustain that practice, which originated with Halogen-bath tin plating, for approximately five decades. However, a number of plating bath aspects which started as environmental concerns several decades ago have continued to increase in urgency so as to presently threaten continuance of Halogen-bath tin plating practice, notwithstanding long recognition for the quality of its tin plated product and other advantages of horizontal passline electrolytic tin plating of a single surface of continuous steel strip at a time.

SUMMARY OF THE INVENTION

Analyzing problems which, over the years, have become problems associated with such horizontal passline tin plating practice, and which have become matters of increasing environmental concern, in particular with Halogen-bath tin plating operations, and devising ways for eliminating those problems and concerns, are central aspects of this invention.

More specifically:

(a) how to eliminate chemical corrosion iron dissolution from continuous strip steel substrate, during single surface plating while the substrate is submersed contiguous to the surface of chemically corrosive plating solution (such as Halogen-bath or methylsulphonic acid (MSA) plating solutions), which introduces iron ions into the plating solution;

(b) how to eliminate, or substantially eliminate, precipitant materials in horizontal passline electrolytic tin plating operations for plating one surface at a time of continuous flat-rolled steel strip;

(c) how to eliminate, or substantially eliminate, loss of stannous plating ions during such horizontal passline plating operations, in particular, loss of stannous ions from Halogen-bath electrolytic tin plating solutions, and (d) how to eliminate the need for, and use of, sodium ferrocyanide in Halogen-bath electrolytic tin plating operations.

Eliminating chemical corrosion dissolution of iron ions in such horizontal passline plating solutions during electrolytic tin plating operations and solving specific environmental concerns with Halogen-bath electrolytic tin plating operations are contributions of the invention discussed in more detail in describing the Figures of the accompanying drawings, in which:

BRIEF DESCRIPTION OF THE DRAWING FIGURES

FIG. 1 is a general arrangement box diagram embodying the invention for describing new combinations of plating steps for carrying out finish-surface tin plating of continuous steel strip in horizontal passline electrolytic tin plating operations;

FIG. 2 schematically illustrates apparatus for simultaneous electrolytic pickling and electrolytic plating of continuous strip steel substrate as carried out in accordance with the invention prior to, and in combination with, horizontal passline electrolytic finish-surface tin plating;

DETAILED DESCRIPTION OF THE INVENTION

Figure 1:
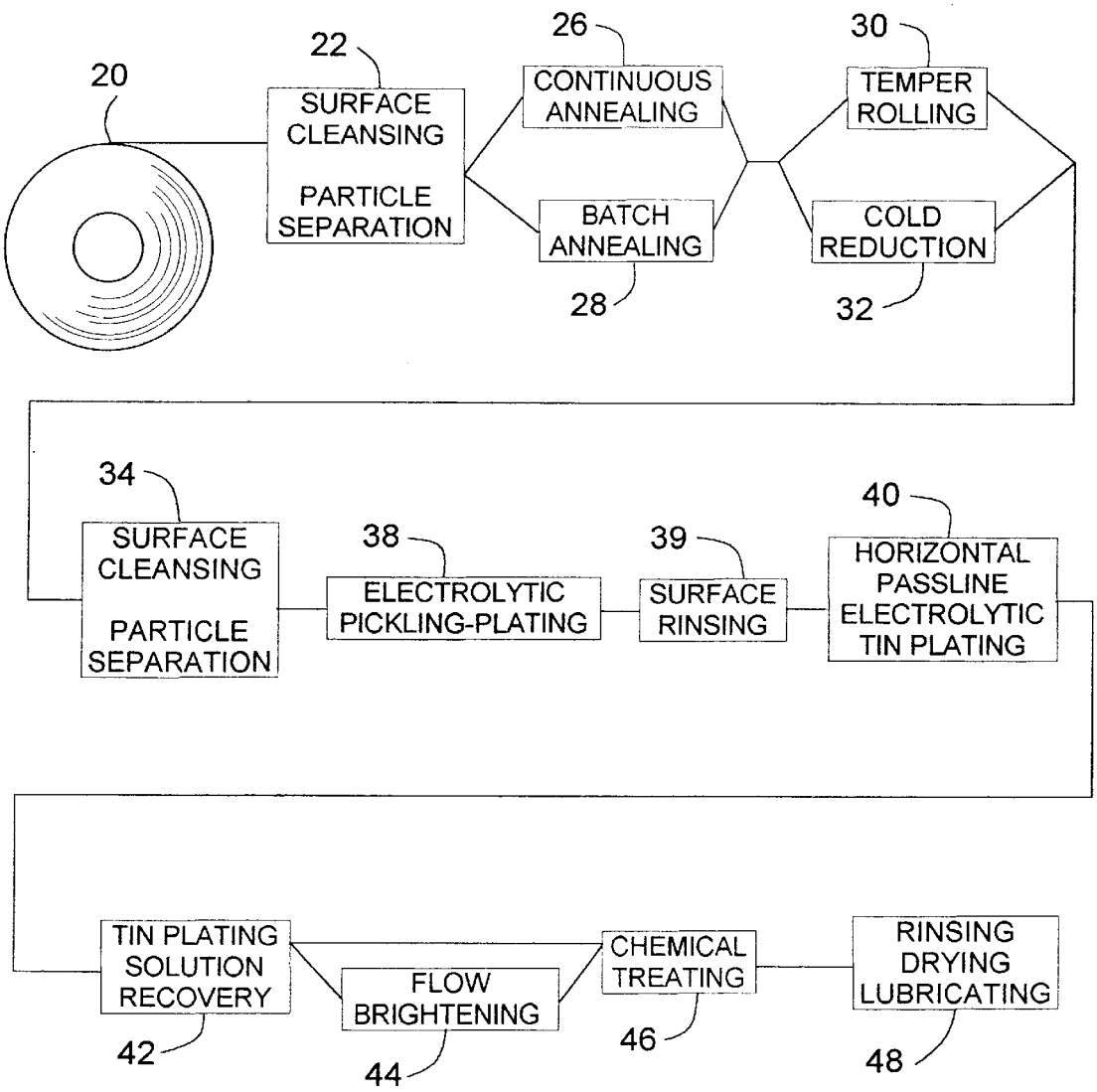

During strip surface preparation, cold-rolled steel strip 20 (FIG. 1) is directed to cleansing operation 22 for removing surface contaminants resulting from cold reduction operations. Surface scrubbing and/or other means are used for removal of iron fines from strip surfaces and cleansing can include separation of such fines from the cleaning solution as described, for example, in more detail in copending and co-owned U.S. application Ser. No. 08/445,530, entitled "Continuous Flat-Rolled Steel Strip Cleansing and Finishing Operations," now U.S. Pat. No. 5,599,395, which is included herein by reference.

Substrate heat treating, subsequent to surface cleansing and prior to plating, is selected dependent on desired use for the finished product. Continuous or batch annealing can be carried out at 26 or 28, respectively. A temper rolling step 30, with minor thickness reduction, improves surface finish, flatness, and mechanical properties of the substrate.

However, certain products require significant cold reduction, indicated at 32, such as a gauge reduction of about twenty-five to about forty per cent in order to increase hardness, yield strength, and tensile strength. Gauges of approximately fifty pounds per base box to about one hundred thirty-five pounds per base box of steel substrate are selected for tin mill practice production of "single reduced" and/or "double reduced" tin plated product.

Supplemental surface cleansing 34, with separation of iron fines, can provide steel strip substrate substantially free of particulate iron or iron oxide in preparation for a portion of the new combination of electrolytic steps (carried out at 38, FIG. 1) of the invention. The strip is then rinsed at 39 prior to being introduced to horizontal passline electrolytic tin plating means 40. After recovery of horizontal passline plating solution at 42, the finish-surface tin plate can be flow-brightened at 44, or a matte finish can be selected, prior to chemical treatment at 46. The latter is followed by rinsing, drying, and preparation for coiling at 48.

Figure 2:
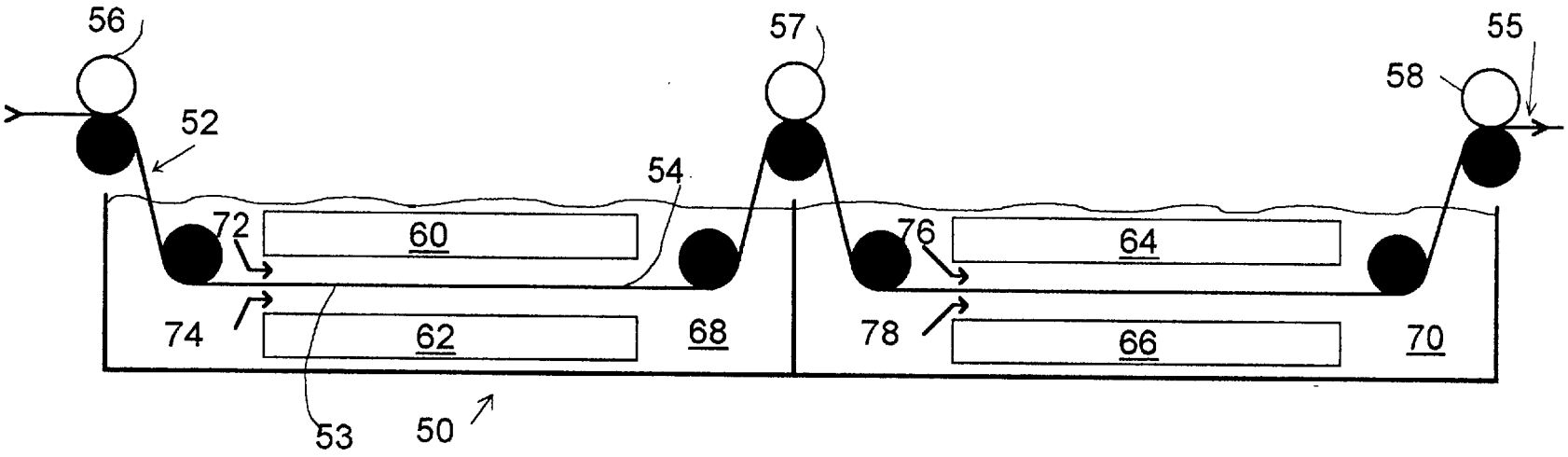

Electrolytic pickling and simultaneous electrolytic plating contributions of the invention are achieved in apparatus shown schematically at 50 in FIG. 2. A continuous-surface strike-coat metal plating is applied simultaneously with electrolytic pickling. The term "strike-coat" is used in part because of the rapid plating carried out during the limited time available for travel through pickling/plating apparatus 50. In practice of the invention, the travel rate of the continuous steel strip in the subsequent in-line horizontal passline electrolytic tin plating operations dictates strike-coat plating time.

However, notwithstanding a short time interval for pickling/plating, the substrate surface, freshly free of iron oxide due to the electrolytic pickling carried out with the strip polarized cathodically, is at its most receptive stage resulting in finely compacted, adherent, continuous-surface electrolytic strike-coat plating. The continuous-surface pickle-plated strike-coat plating characteristics are particularly adapted to requirements of the invention; that is, protecting continuous strip steel substrate surfaces under conditions experienced in subsequent chemically corrosive plating solutions found in horizontal passline tin plating operations in which a single surface of the strip is plated at a time.

Referring to the pickling/plating embodiment schematically illustrated at 50 in FIG. 2, each cell of pickling/plating apparatus 50 contains a sulfuric acid-type solution for pickling. Strip 52 travels through the pickling/plating solution, with submersed anodes confronting its upper and lower surfaces for simultaneous plating of lower planar surface 53 and upper planar surface 54.

As taught herein, selected quantities of tin and/or nickel sulfate are added to the sulfuric acid pickling/plating solution to maintain a desired concentration of divalent plating ions so as to achieve, with cathodic plating action, a desired tin, nickel or combined tin/nickel strike-coat plating. The sulfate ions of the tin and/or nickel sulfate, as added, go into solution and are compatible with the sulfuric acid pickling/plating solution of apparatus 50.

Strip 52 is maintained cathodic in pickling/plating apparatus 50. To achieve that polarity, conductor rolls such as 56, 57 and 58 are mounted in electrical contact with the strip during its in-line travel, as schematically shown, intermediate the pairs of anodes 60, 62 and 64, 66. In the embodiment being described, the anodes are insoluble. The concentration of the sulfuric acid solution, the concentration of tin and/or nickel ions, electrolytic requirements, and resulting strike-coat tin and/or nickel plating, for carrying out the invention, are shown in FIGS. 3 and 4, respectively.

Figure 3:
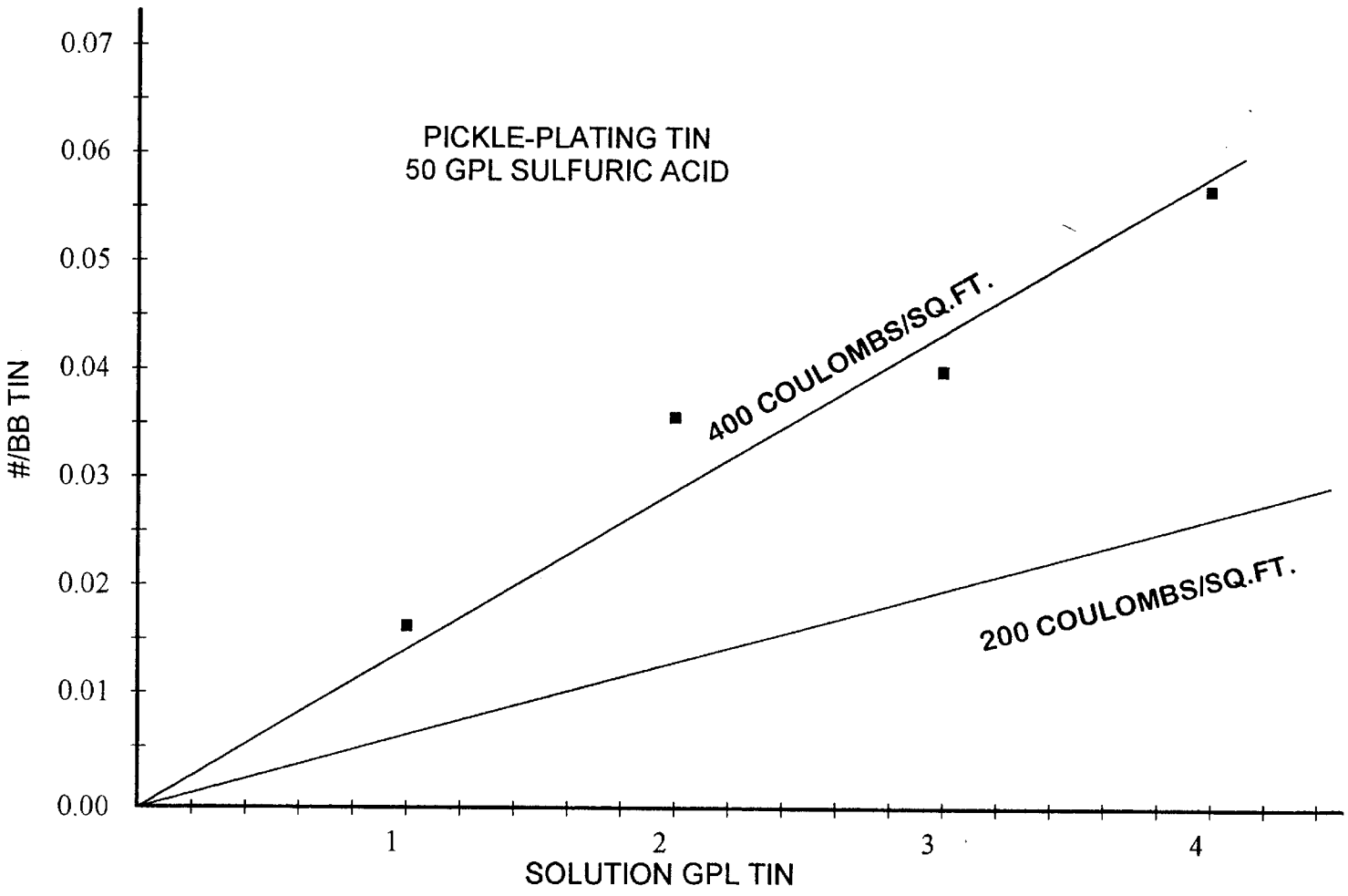
FIG. 3 is a graphical presentation with data, for describing a range of values and control factors, for electrolytic pickling and simultaneously plating a tin strike-coat in accordance with, and as used in, the new combination of the invention.
Figure 4:
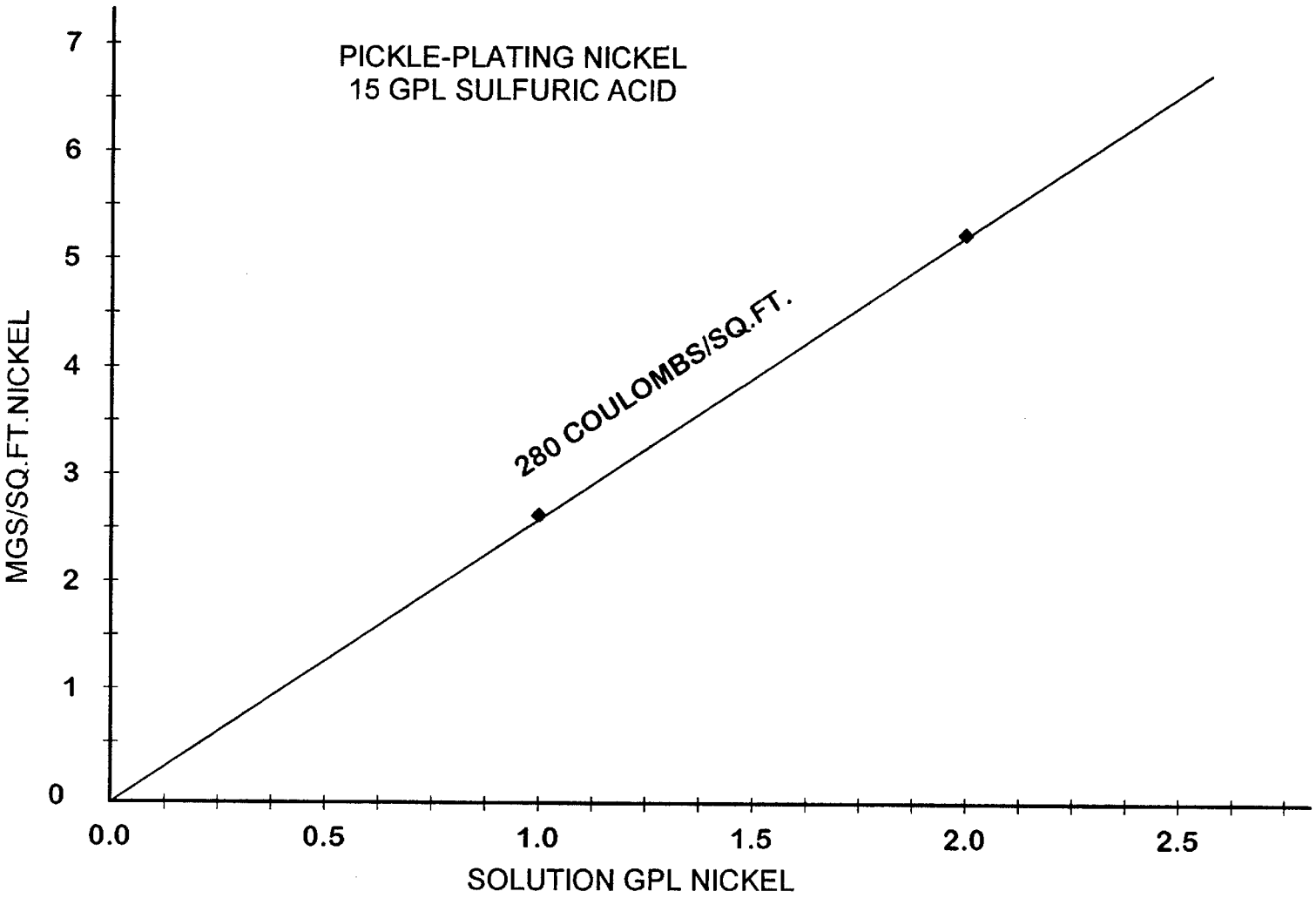
FIG. 4 is a graphical presentation with data, for describing a range of values and control factors for electrolytic pickling and simultaneously plating a nickel strike-coat in accordance with, and as used in, the invention.

Forced flow of pickling/plating solution, as indicated by arrows 72, 74 and 76, 78, comprises an important teaching in order to enable more effective use of the control factors shown in FIGS. 3, 4. In particular, flow as indicated by arrows 74, 78 enables selective plating along the lower surface 53 of the strip 52. Hydrogen, in the form of small bubbles, effervesces from each cathodic surface of the strip during pickling/plating. While such hydrogen bubbles can escape through perforations (not shown) in anodes 60, 64 (or around those anodes), the effervescing bubbles from surface 53 of strip 52 can tend to become trapped along that planar surface of the strip. Their accumulation along lower surface 53 can inhibit selective control of strike-coat plating on that surface of strip 52.

Forced flow of the sulfuric acid pickling/plating solution, as indicated by 74, 78, in coordination with strip movement, helps to controllably move such hydrogen bubbles along surface 53 of strip 52 during its passage through pickle-plating apparatus 50.

In certain horizontal passline plating solutions, such as Halogen-bath plating solution, a slight pickle-plating on surface 53 has been found to provide sufficient protection since finish-surface tin plating of that surface is initiated rapidly in the first cell of the first horizontal plating pass. However, forced flow, as indicated by 74, 78, can provide for selecting and making possible strike-coat plating on lower surface 53 equivalent to that plated on the opposite upper surface 54 of strip 52.

Establishing a selected quantitative plating and the strike-coat characteristics are important on upper surface 54. As described in relation to subsequent horizontal passline apparatus (FIGS. 6, 7), the pickle-plating strike-coat on surface 54 must protect that surface during passage through the entire first tier of plating cells of the first horizontal plating pass when that surface would otherwise be exposed to chemical corrosion dissolution of iron in each such cell.

Important characteristics of strike-coat plating are its uniformity, complete surface coverage, and small plating nodule density. The strike-coat plating is applied to a pristine surface; that is, such plating is deposited on a surface which is freshly free of iron oxide and is plated simultaneous with pickling, with no opportunity for oxidation; and the strike-coat is plated while the steel surface is most receptive to adherent plating. The coherence of the strike-coat plating is due in part to the hydrogen bubbles from the cathodic substrate surface. Such hydrogen bubbles are believed to help establish the fine-plating nodules which establish a continuous high-density compact plating. As indicated by the photomicrograph enlargement (6000×) of FIG. 5, the strike-coat comprises small plating nodules which are surface-continuous and pore-free.

As discovered with the chemically corrosive plating solutions of subsequent horizontal passline operations, the pickle-plating exhibits a unique surface adherence and continuity affording greater surface protection with less surface erosion than experienced with Halogen-bath tin platings. The pickle-plating on surface 54 must be able to withstand chemical corrosion of the strike-coat plating by the plating solution on that surface.

A pickle-plating strike-coat tin plating along surface 54 is preferably selected at about 0.02 to about 0.05 pound of tin per base box of surface area. That pickle-plating will prevent dissolution of iron ions into the Halogen-bath plating solution and provide strike-coat substrate plating for addition of the finish-surface tin plated product. A nickel plating to provide equivalent, or increased, protection to that of the above tin strike-coat plating weight range is preferably selected in the range of about one (1) to about ten (10) milligrams (mgs) of nickel per square foot (sq. ft.) of surface area (FIG. 4).

Such simultaneous pickling and plating are carried out rapidly in the new combination of the invention. Pickling/plating is carried out at line speeds established by the in-line combination of horizontal passline plating operations. When using Halogen-bath tin plating means, line speed averages fifteen hundred fpm, in which case travel time for strip 52 in the pickling/plating apparatus 50 is about one (1) second.

Quantitative data for strike-coat tin and/or nickel plating per unit surface area are shown graphically in FIGS. 3 and 4. Varying pickling/plating ion concentrations, coulomb levels (electrical current values which take into account the time factor) and sulfuric acid concentration are provided which enable strip 52 (entering apparatus 50) to travel at the line speed of a subsequent horizontal passline electrolytic tin plating operation while achieving desired quantitative strike-coat plating control.

The high effervescent rate of hydrogen bubbles is one factor in plating efficiency; in apparatus 50, the plating efficiency is about twenty-five percent (25%). That plating efficiency, the surface area, and strip travel rate determine the coulombs required as set forth in FIGS. 3, 4.

Coulombs measure the quantity of electricity; each coulomb represents $6.25\times10^{18}$ electrons. The coulombs (or ampere seconds) per sq. ft. for selecting desired strike-coat plating of tin or nickel, as shown in FIGS. 3, 4, are selected based on plating efficiency, strip width, two surfaces, and strip travel.

Referring to FIG. 3, with a pickle-plating solution having a sulfuric acid concentration of fifty (50) grams per liter (gpl) at 400 coulombs per sq. ft., about 0.02 #/bb of tin strike-coating is deposited from a solution having a stannous ion concentration of 1.2 gpl; at two (2) gpl stannous ion concentration, about 0.035 #/bb of tin is plated; and at four (4) gpl stannous ion concentration, about 0.055 #/bb tin is plated.

Referring to FIG. 4, with a pickle-plating solution having a sulfuric acid concentration of fifteen (15) gpl and divalent nickel ion concentration of 1.0 gpl, approximately two point five (2.5) mgs of nickel per sq. ft. is plated at 280 coulombs per sq. ft.; and with two point zero (2.0) gpl divalent nickel ion concentration, approximately five (5) mgs of nickel per sq. ft. is strike-coat plated.

Figure 5:
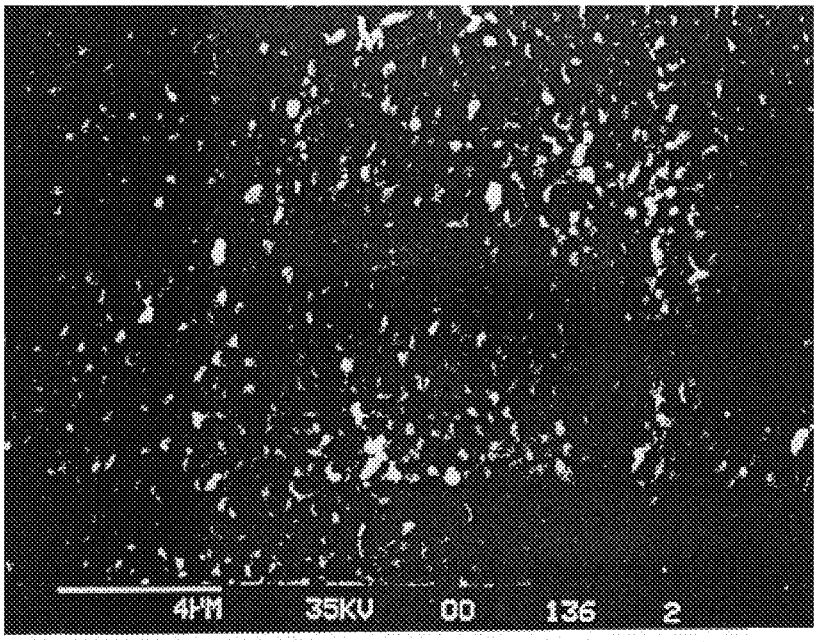
FIG. 5 is a photomicrograph enlargement (6000×) of a continuous-surface strike coat plating of the invention resulting from the cathodic electrolytic pickling and simultaneous electrolytic metal plating step of the invention.

The uniform size of the plating nodules as pickle-plated, and the pore-free continuity of the strike-coat plating are shown by the enlarged photomicrograph (6000×) of FIG. 5. Those characteristics contribute to the surface protection provided in the subsequent horizontal passline corrosive tin plating solution, and as an important subsurface portion of the finish-surface plated product.

Strip 55 exits from electrolytic pickling/plating apparatus 50 (FIG. 2) with sulfuric acid solution on both surfaces. In order to avoid contamination of subsequent in-line Halogen-bath or MSA tin plating solutions, the strike-coat pickling/plating solution is rinsed as indicated by surface rinsing 39 of FIG. 1.

The strike-coat plating, by protecting the steel substrate which would otherwise be subject to chemical corrosion dissolution of iron ions during single surface plating in a Halogen-bath, makes an important and significant contribution to eliminating earlier mentioned major environmental concerns. Prior Halogen-bath tin plating operations required the addition of sodium ferrocyanide to the plating solution in order to provide for precipitation removal of ferric ions. By eliminating dissolution of iron ions, the need for sodium ferrocyanide is eliminated.

Also, iron dissolution in previous Halogen-bath plating solutions acted as a catalyst causing increased conversion of stannous ions to stannic ions. That result depleted the source of tin for plating and caused precipitation which had to be removed and processed. Stannic ion precipitant is substantially alleviated by the elimination of iron dissolution in the plating solution.

Further, the previously required removal of ferric ions by precipitation resulted in a hazardous waste, prussian blue sludge; it has been projected that dump sites for prussian blue will dwindle and, considering governmental environmental regulations, any remaining dump sites may be short lived.

The simultaneous pickling/plating taught in the new combination of the invention enables elimination of iron dissolution from the steel strip into the chemically corrosive plating solutions used in horizontal passline electrolytic tin plating lines for plating a single surface at a time. Precipitation problems of longstanding and increasing environmental concern with Halogen-bath tin plating lines are eliminated efficiently and effectively, while improving the finish tin plating process and product.

Figure 6:
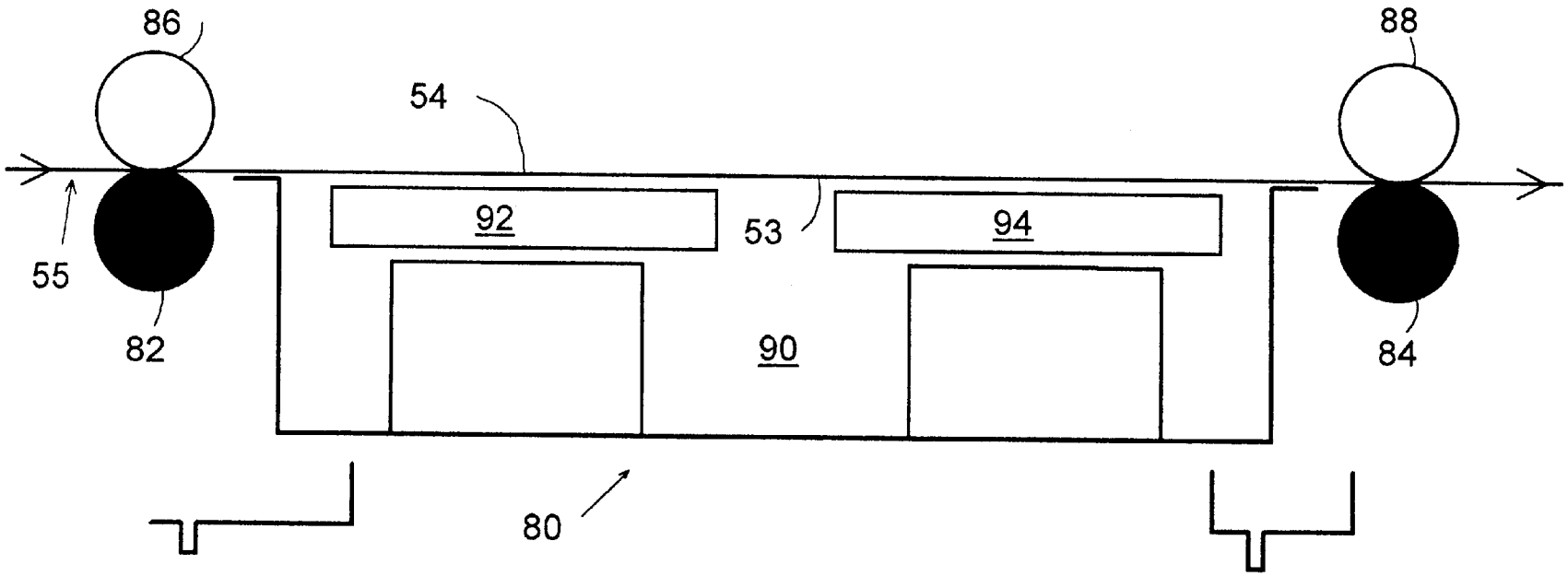
FIG. 6 is a schematic cross-sectional view of a specific embodiment of a horizontal passline electrolytic tin plating cell for describing contributions of the new combination of plating steps of the invention.
Figure 7:
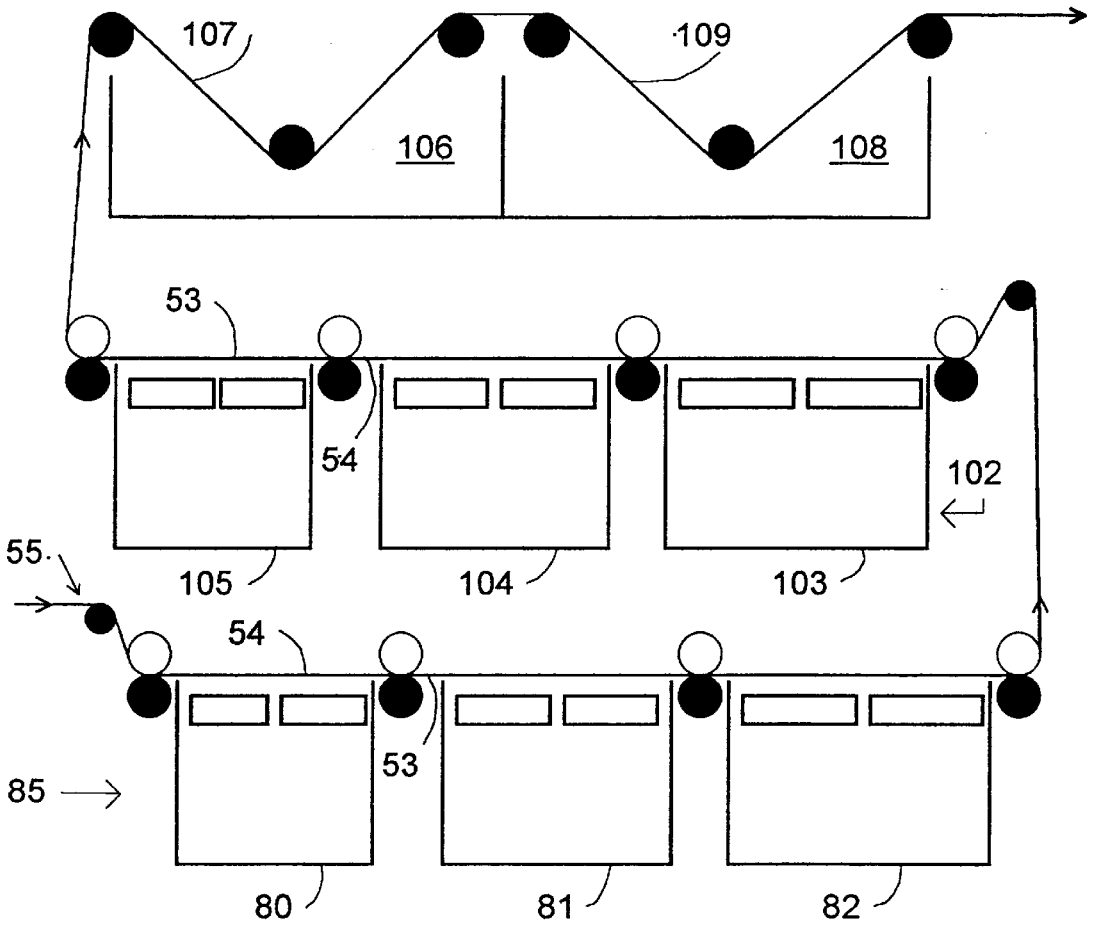
FIG. 7 is a schematic cross-sectional view of a specific embodiment of a horizontal passline electrolytic tin plating line for describing finish-surface tin plating operations of the novel combination of the invention.

For description of a specific horizontal passline embodiment the invention, a Halogen-bath cell and Halogen-bath line are shown in FIGS. 6 and 7, respectively. One surface of the substrate is plated at a time in such horizontal passline electrolytic tin plating means. Previously, before tin plating could be completed on both surfaces in such a line, iron ions, in particular from the upper surface (54) of the strip during its travel in the plating cells of the first deck, would go into solution in the Halogen-bath plating solution. The plating solution was contaminated with ferrous ions which, after being converted to ferric ions, depleted stannous ions.

However, with the present invention, in plating cell 80 and subsequent plating cells 81, 82 of a first horizontal deck 85 of FIG. 7, the upper surface (54 as indicated in FIG. 2) of the steel substrate is shielded during the entire passage through such plurality of plating cells by the highly-protective pickle-plating strike-coat applied in apparatus 50.

As taught herein, the steel strip has been the main source of iron dissolution; that source, which had existed for decades in prior Halogen-bath tin plating operations, is eliminated. Other steps which help to eliminate lesser iron ion dissolution sources include: use of chrome plated or stainless contact rolls in the horizontal passline, and avoiding any iron fines being carried with the strip into the plating solution.

Strike-coat plating of the upper surface 54 is selected to be sufficient to offset the corrosive attack of the Halogen-bath plating solution which previously removed iron ions in first tier 85. Further, an equal or lighter strike-coat plating applied to surface 53 of the strip in pickling-plating apparatus 50 eliminates any chance for a relatively small amount of iron ions going into solution from that surface in the first tier 85; that is, before sufficient Halogen-bath tin plating of that submersed surface takes place in the first cell 80 of that tier.

Passage through the pickling-plating apparatus 50 can provide sufficient protection for plating cell 80, notwithstanding hydrogen bubble accumulation along strip surface 53. That is, surface 53 is rapidly plated in the first cell (80) of the first deck of the Halogen-bath line. However, in practice, by using forced solution flow in apparatus 50, both surfaces can be substantially equally plated and an overall improved product for tin plate commercial usage is provided.

Referring to FIGS. 6, 7, electrolytically pickled and strike-coat plated strip 55 enters a horizontal passline single-surface tin plating means, such as the specific embodiment Halogen-bath multi-deck apparatus shown schematically in FIG. 7. Strike-coated strip 55 enters individual plating cells, such as 80 (shown in more detail in FIG. 6) and travels through subsequent cells 81, 82 of the first deck 85; the substantially horizontal travel path passline for the strip is, at least in part, determined by pressure rolls 82 and 84 and electrical contact rolls 86 and 88 (as shown in FIG. 6). The steel strip travels submersed but contiguous to bath surface level in Halogen-bath plating solution 90 (FIG. 6). Anodes 92 and 94 are positioned below such bath surface level. The plating solution 90 and the positioning of the anodes are used in each Halogen-bath plating cell to provide for Halogen-bath plating uniformity on the planar surface of the strip being plated. Differential plating (that is, different plating weights on each surface) can be readily achieved and better tracking and handling of lighter gauge strip are available in horizontal passline practice. More details of Halogen plating line means are disclosed in co-owned U.S. Pat. No. 5,346,607 ELECTROLYTIC TINPLATING AND PRODUCT, or *The Technology of Tinplating* by W. E. Hoare et al., St. Martin's Press 1965, NY, N.Y., pages 239–242, which are incorporated herein by reference.

In accordance with the invention, the upper surface 54 of strip 55 is protected during passage in the first deck 85 by the pickle-plating applied to that surface in apparatus 50. The strike-coat tin plating weight on surface 54 is selected in a range from about 0.02 to about 0.05 #/bb; or, in a range of about one (1) to about ten (10) mgs/sq. ft. nickel utilizing the data and graphs of FIGS. 3, 4, respectively.

FIG. 7 shows tier 102 with three plating cells (103, 104, 105) in sequence in that tier. In horizontal passline electrolytic tin plating practice, a single surface is plated in each tier. As indicated, passage through the first tier 85 (for plating of surface 53) is followed by passage in the opposite direction through plating cells of the second tier 102 for plating the opposite planar surface 54 of the strip which has been protected in the first tier by strike-coat plating deposited in apparatus 50.

Solution recovery means 106 provides for recovering plating solution remaining on steel strip 107, and rinse means 108 is provided for rinsing such plated strip 109 prior to further processing.

Benefits of eliminating iron ion dissolution have ramifications within, and beyond, finish-surface tin plating operations. Considering the Halogen-bath electrolyte specific embodiment, the major source of tin in Halogen-bath tin plating lines comprises tin fluoride complexes. Tin is plated from solution in the stannous state. In previous practice, iron ions from the steel substrate entered the solution as ferrous ions and were converted to ferric ions; that problem is eliminated by elimination of iron ion dissolution. And the prior loss of stannous ions, which attended conversion of ferric ions to ferrous ions, is eliminated. (Stannous ions are also relied on for plating in MSA baths; that is, the advantage of decreasing loss of stannous ions extends to such other horizontal passline tin plating solutions).

Also, significantly and importantly, in prior practice sodium ferrocyanide was a required additive to the Halogen-bath in order to provide for a ferric ion precipitate. The result was a hazardous sludge referred to as prussian blue. Eliminating iron ions going into solution, as taught in the present invention, eliminates the need for sodium ferrocyanide. Precipitation of a hazardous waste, which has become a major environmental concern, has been eliminated. By eliminating both stannic ion and ferric iron precipitants, the present costly tin reclamation from Halogen-bath sludge can be eliminated.

However, the high rate of movement at which strip enters the Halogen-bath at the surface of each cell can drag (or slush) air into the bath. Some of that air enters the bath as oxygen. Such oxygen can be a factor in the conversion of stannous ions to stannic ions. Therefore, an added step, as more comprehensive elimination of sludge is considered as part of the invention, is to also add an antioxidant (such as an organic amine) to the Halogen-bath solution. A much lower antioxidant concentration than that which would be required if iron ions from the steel substrate were going into solution can easily be maintained in the Halogen-bath plating solution to help eliminate a possible cause for conversion of stannous ions to stannic ions. Such antioxidant can readily be added to a desired concentration using the plating solution handling means of Halogen-bath lines, as partially shown in FIG. 6 and as described in *The Technology of Tinplating* referenced above. The antioxidant can thus eliminate any sludge due to conversion of stannous ions to stannic ions, and provide for a more efficient plating operation. Suitable antioxidants, which do not disturb desired plating solution chemistry, are available from ATOTECH USA, INC., 100 Harvard Avenue, Cleveland, Ohio 44109.

Figure 8:
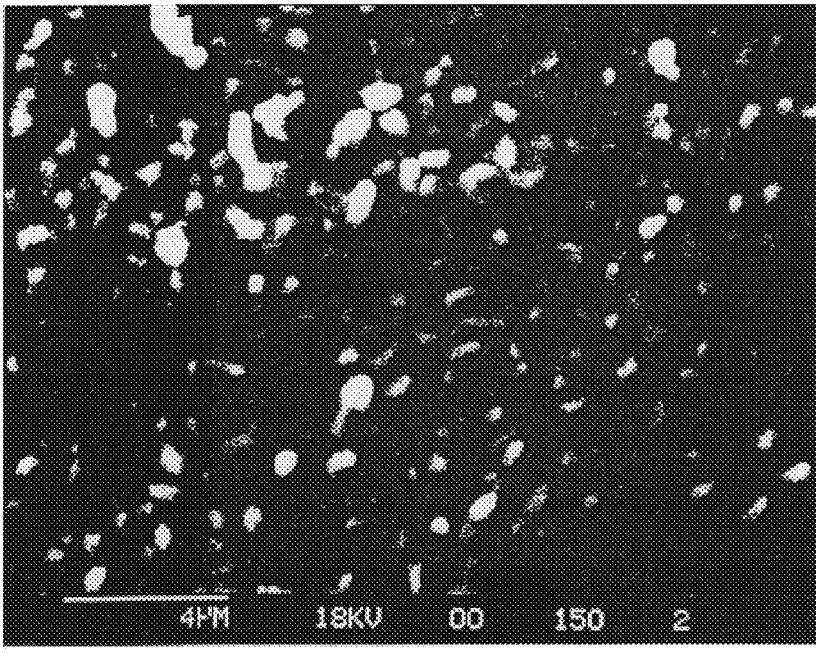
FIG. 8 is a photomicrograph enlargement (6000×) of a Halogen-bath finish-surface tin plating which covers a substrate surface strike-coat metal plating as shown in FIG. 5.

A photomicrograph enlargement (6000×) of the Halogen-bath tin nodules is shown in FIG. 8. The fine nodule continuous surface strike-coating of FIG. 5 provides a highly protective subsurface for the large nodules of the Halogen-bath finish-surface plating shown in FIG. 8. The two platings combine to provide enhanced consumer product protection for the substrate due, in significant part, to the continuous-surface highly adherent pickle-plating. The complete surface coverage and coherent characteristics of such subsurface pickle-plating also extend to the alloy layer formed from a tin pickle-plating.

The range of Halogen-bath finish-surface tin platings, whether using strike-coat plating of tin or nickel, can extend from 0.05 pound to 1.35 pounds of Halogen-bath tin per base box surface area. However, indications are that such pickling/plating bath will decrease the desired range of finish-surface tin plating to a pound or less of tin per base box for most consumer product uses. A preferred range of Halogen-bath tin plating may extend to about 0.75 #/bb with a tin pickle-plating of about 0.025 #/bb.

Figure 9:
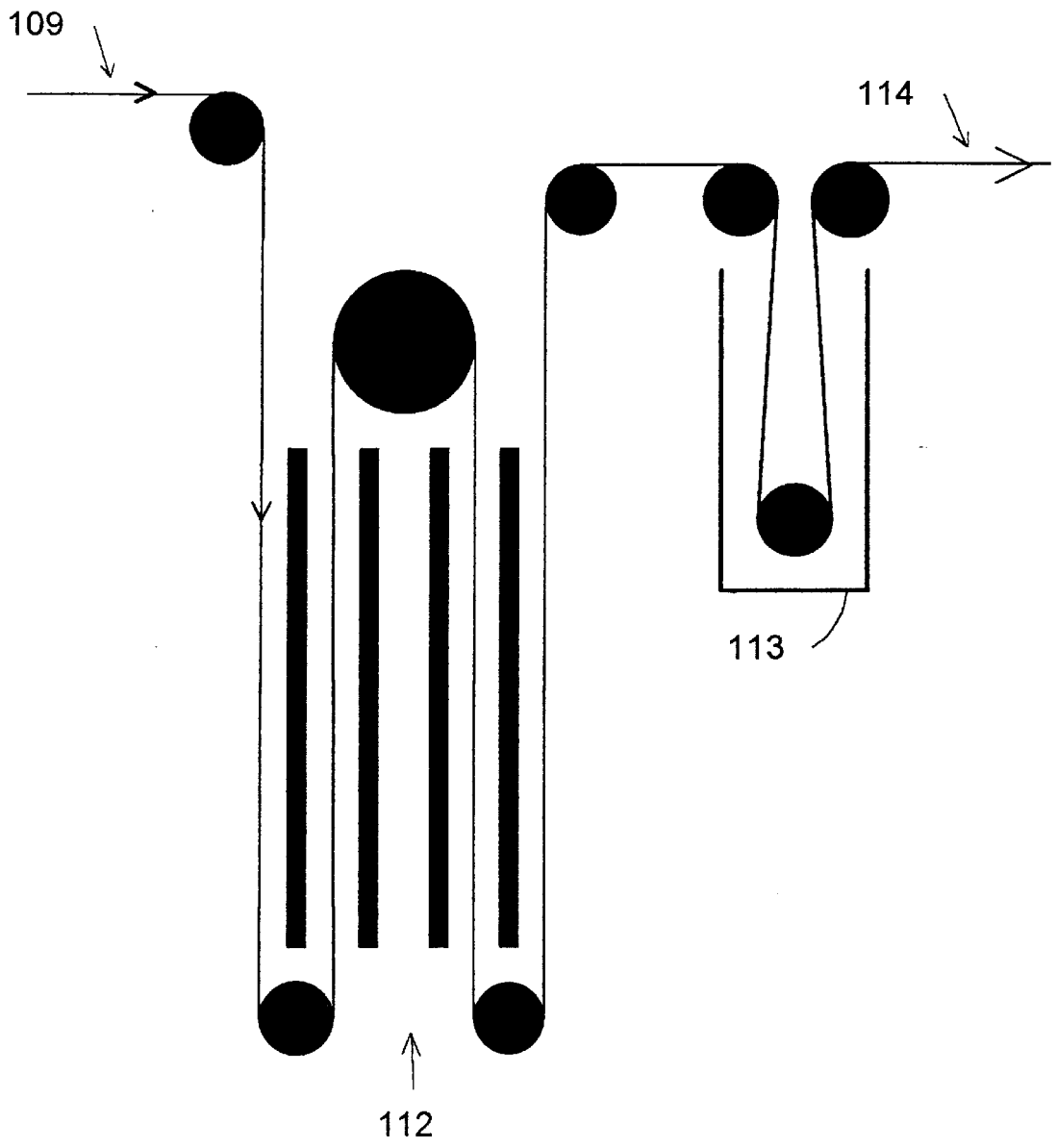
FIG. 9 is a schematic view of apparatus for describing added combinations of steps, after exit from horizontal passline electrolytic tin plating means, such as the specific embodiment Halogen-bath means, which contribute to the range of new products made available by the invention.
Figure 10:
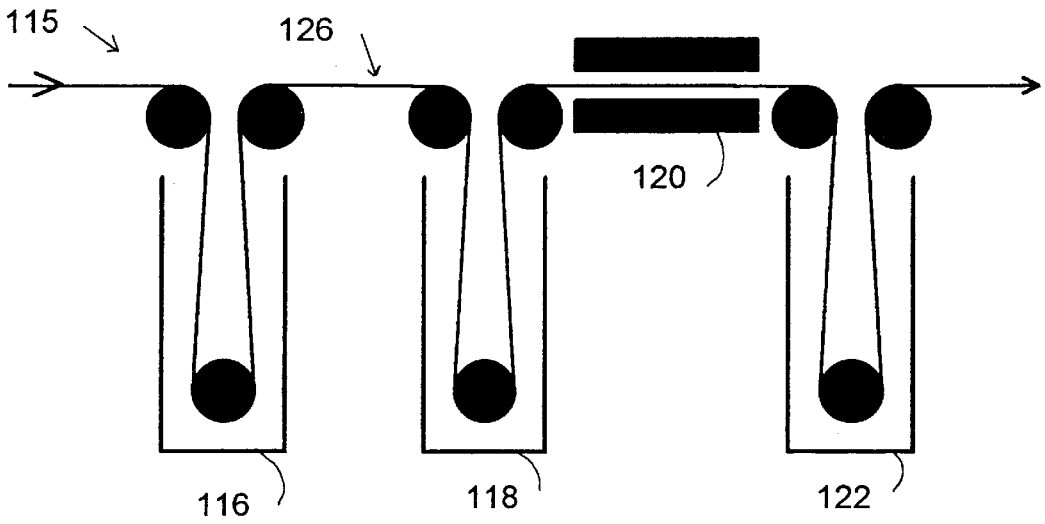
FIG. 10 is a schematic view of apparatus for describing steps, added to those of FIG. 9, for additional protection combinations.

FIGS. 9, 10 schematically illustrate apparatus for further processing, after Halogen-bath tin plating, which provide product options involving various tin plate finishes. Matte finish tin plated strip 109, after Halogen-bath tin plating, solution recovery and rinse operations, can be directed (FIG. 9) through reflow heaters 112 (such as induction or infrared surface heaters), followed by quench tank 113 to emerge as flow-brightened tin surface strip 114. A feature of induction heated flow-brightened product is formation of a tin iron (SnFe) alloy layer at the interface of the steel substrate and tin plate.

The flow-brightener can be deactivated, or an alternate path 115 (FIG. 10) can provide for direct handling of matte finish tin plate 109. Subsequent handling of either matte-finish or flow-brightened tin plated steel is shown in FIG. 10. Chemical treatment, such as a cathodic dichromate bath treatment, or a phosphate bath treatment (indicated by 116), provides surface passivation for storage or for delays in further processing. Following such passivation treatment, strip 126 is rinsed with demineralized water at apparatus 118, and dried at drier apparatus 120. To further protect the coated steel product during coiling, uncoiling or other handling operations, an organic lubricant can be applied at station 122 prior to coiling.

Figure 11:
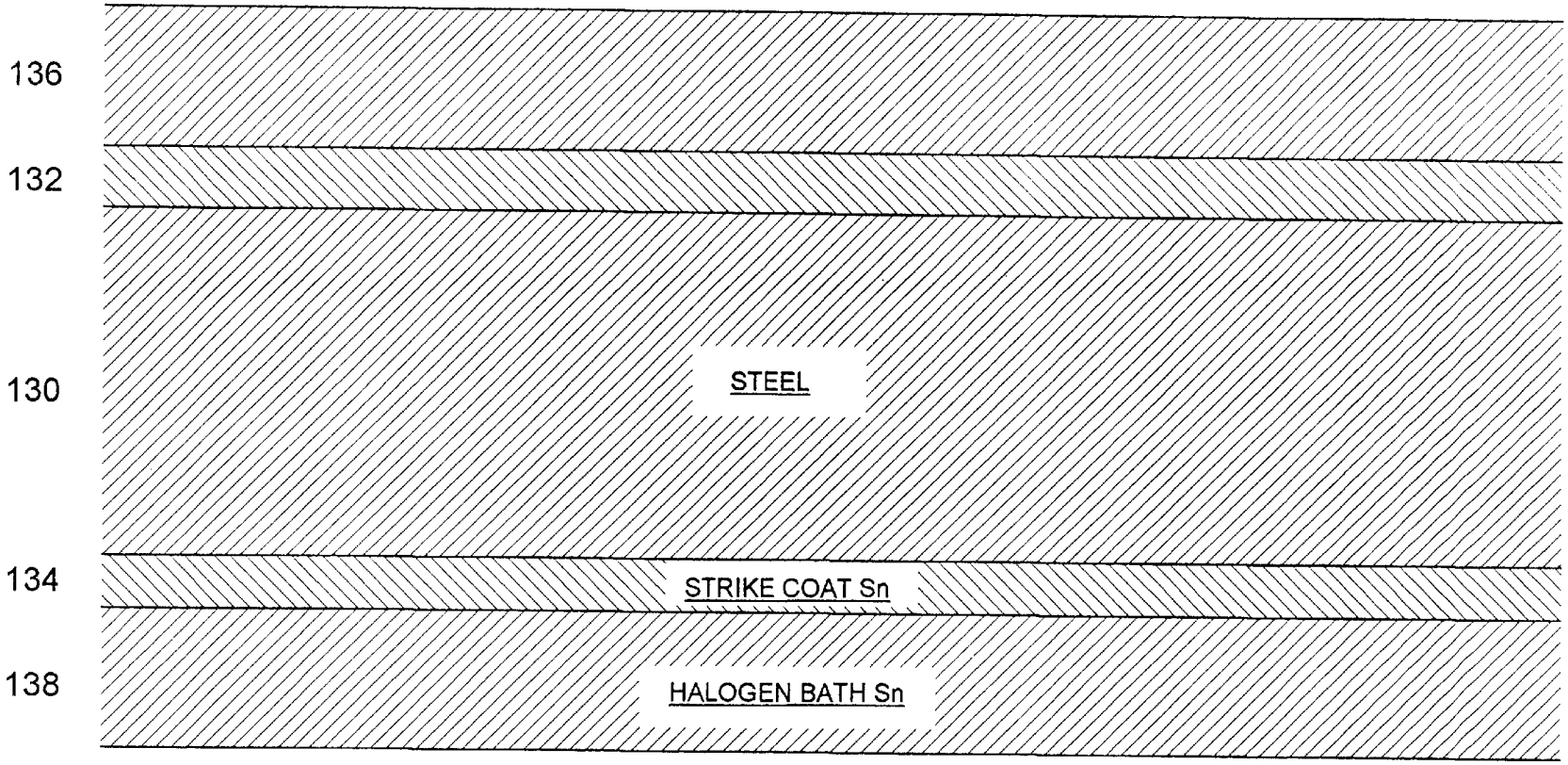
FIG. 11 is an enlarged cross-sectional view of a new electrolytically plated flat-rolled steel product for describing substrate protection made available by the invention.
Figure 12:
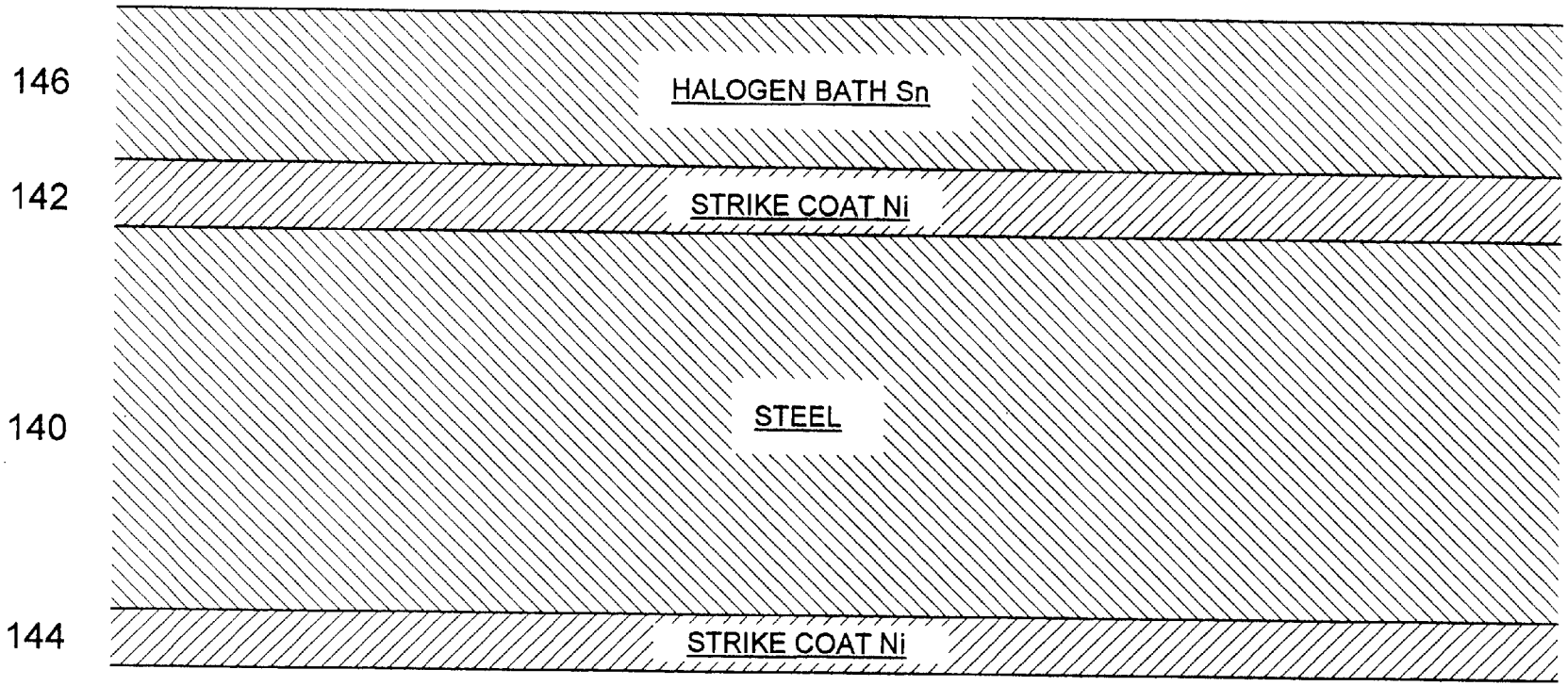
FIG. 12 is an enlarged cross-sectional view of a strike-coat plated product of the invention, with single surface Halogen-bath tin plating which has advantages for further processing.

FIGS. 11 and 12 show enlarged cross-sectional views of two new products. In FIG. 11, the steel strip 130 is electrolytically pickle-plated to provide strike-coat tin plating 132, 134 on each respective substrate planar surface, and a Halogen-bath finish-surface tin plate 136, 138 on each respective strike-coat plated surface. Such Halogen-bath finish-surface tin plate can be flow-brightened and quenched.

Steel substrate 140 of FIG. 12 has been electrolytically pickle-plated to provide strike-coat nickel plating 142, 144 in accordance with the invention, on each respective planar surface. A Halogen-bath tin finish-surface plating layer, such as 146, is plated on at least a single strike-coat nickel plated surface. The product of FIG. 12 can include matte finish tin plate on both surfaces (not shown) and would be suitable for further finish-surface processing.

Figure 13:
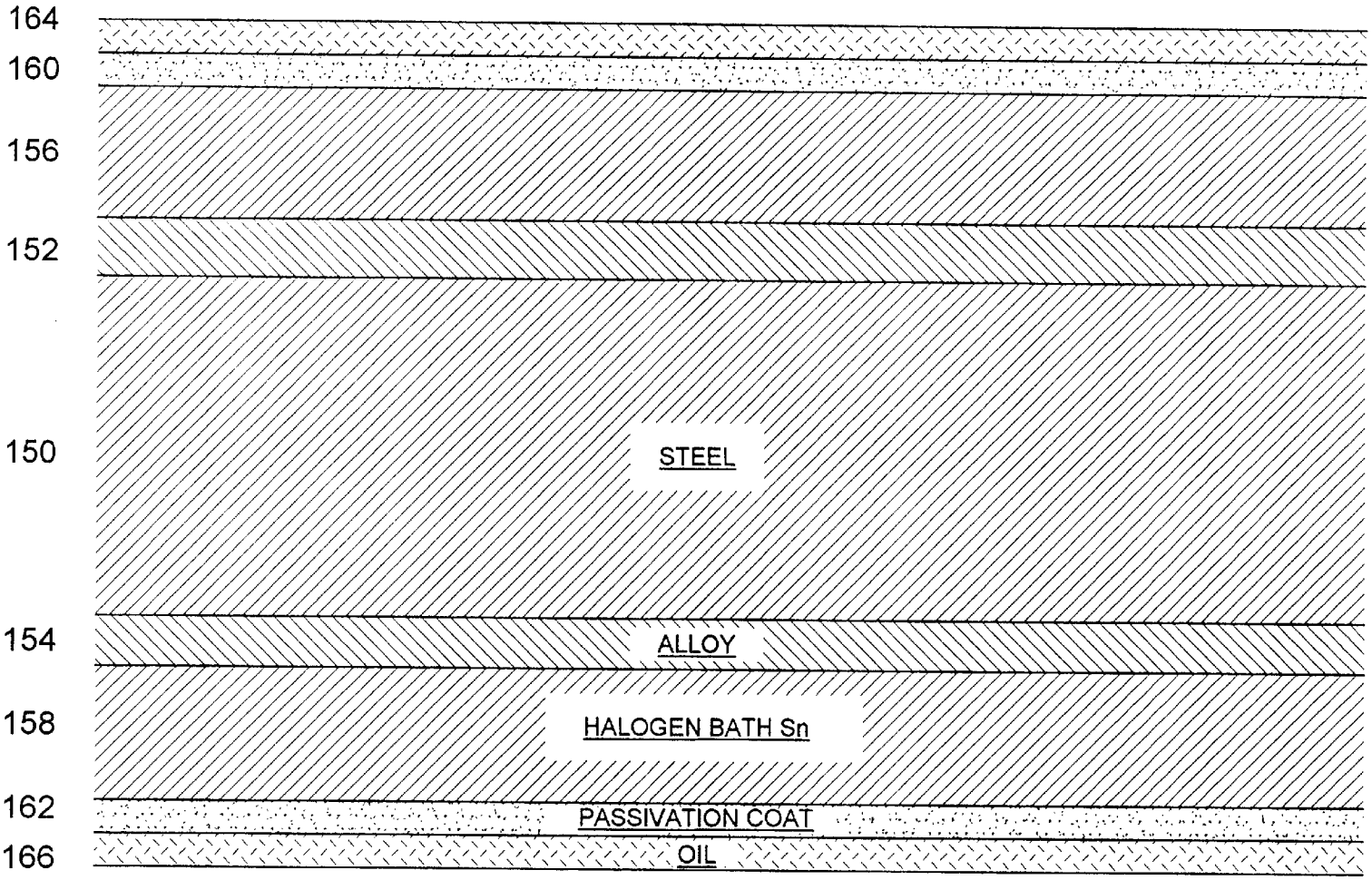
FIG. 13 is an enlarged cross-sectional view for describing a new finish-surface tin plated product of the invention.
Figure 14:
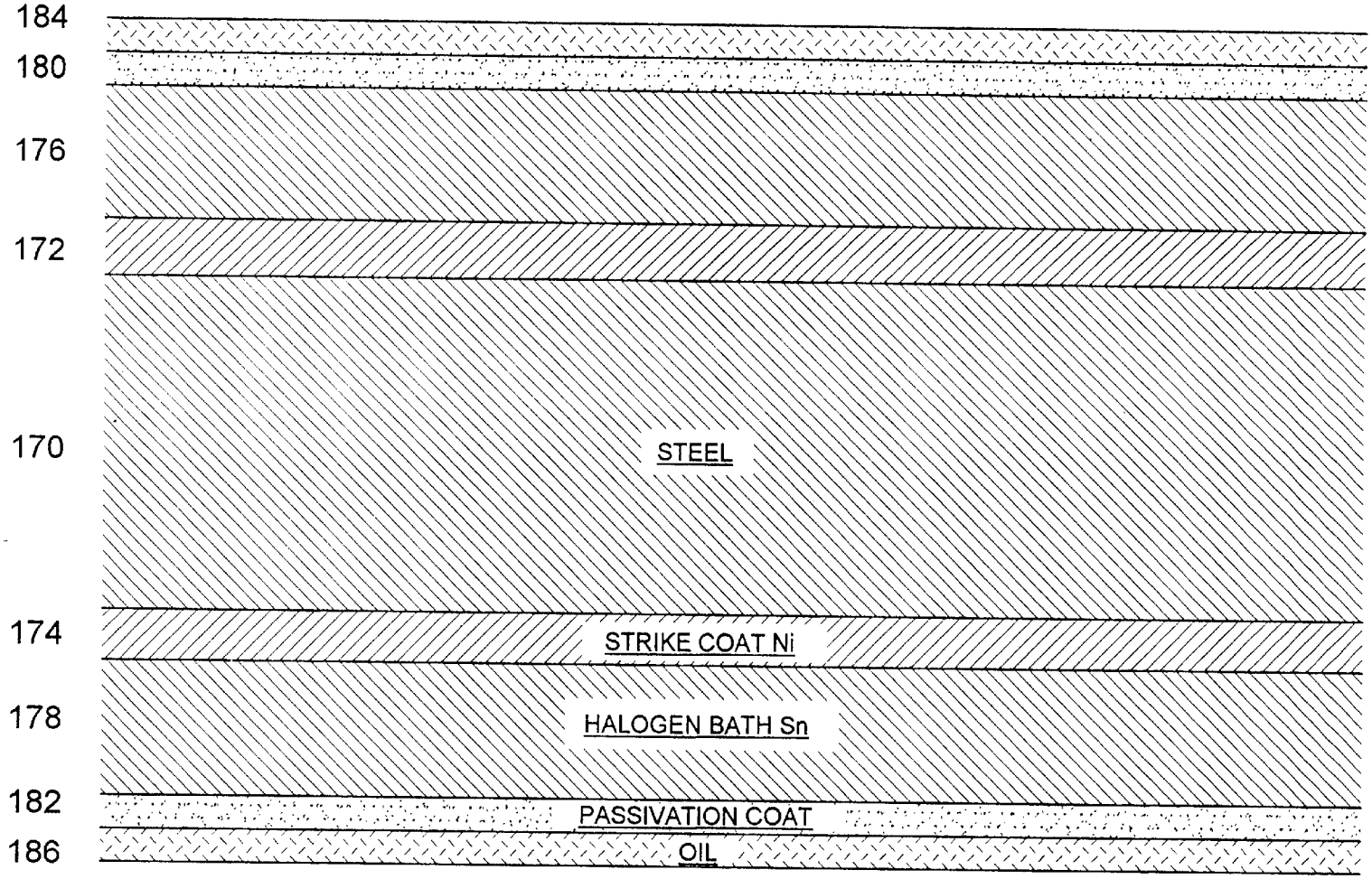
FIG. 14 is an enlarged cross-sectional view of a new product of the invention with nickel strike-coating of the steel substrate and Halogen-bath tin plated finish-surfaces.

FIGS. 13 and 14 are enlarged cross-sectional views of two new products. In FIG. 13, the steel strip 150 is electrolytically pickle-plated on each planar surface with strike-coat tin plating, followed by horizontal passline finish-surface electrolytic tin plate on each surface. A portion of the tin plate at each interface is alloyed by reflow heating to produce tin-iron alloy layer 152, 154 on each respective surface. The flow-brightening finish-surface tin plate is indicated at 156, 158. A chemical passivation treatment 160, 162 is added to each respective tin plate finish-surface. An organic lubricant coating 164, 166 is applied to each respective surface prior to coiling.

To produce the new product of FIG. 14, steel strip 170 is electrolytically pickle-plated on each planar surface with nickel strike-coat plating 172, 174, respectively; following such pickle-plating, a Halogen-bath finish-surface tin plate layer 176, 178 is added to each respective surface. Such Halogen-bath tin plating can be maintained as a matte finish or can be flow-brightened. Slight alloying of tin and nickel interface can occur during induction heating flow brightening of a subsurface nickel pickle-plated product. Chemical passivation treatment 180, 182 and organic lubricant coating 184, 186 are applied to each respective surface prior to coiling.

Specific processes, apparatus, materials, values, and ranges have been set forth for purposes of describing the invention and specific embodiments of the invention. It should be recognized that the above teachings will enable those skilled in the art not only to understand and use the invention, but may also enable modifications or other process steps, values, and the like, which have not been specifically detailed in the above description. Therefore, it should be understood that reference shall be made to the appended claims for purposes of determining the scope of the present invention.

We claim:

1. Halogen-bath plating solution for electrolytic tin plating of a planar surface of elongated continuous-strip flat-rolled steel, while such steel strip is traveling substantially horizontally in the direction of its length, through a plurality of Halogen-bath electrolytic plating cells; such Halogen-bath plating solution comprising:

a stannous ion plating solution having a pH of about 3.5, which is substantially:

(i) free of iron ions due to chemical dissolution of iron from such continuous-strip steel, (ii) free of cyanide additives for precipitation removal of dissolved iron resulting from chemical dissolution of iron from such continuous-strip steel, and (iii) free of precipitant, resulting from such chemical dissolution of iron from such continuous-strip steel, during such halogen-bath electrolytic tin plating operations.

* * * * *